US009080293B2

(12) United States Patent
Graner et al.

(10) Patent No.: US 9,080,293 B2
(45) Date of Patent: Jul. 14, 2015

(54) SELF-PROPELLED SURFACE MILLING MACHINE WITH ELECTRICAL MILL ROLL DRIVE

(75) Inventors: Klaus Graner, Ahlen (DE); Johann Lis, Riedlingen (DE)

(73) Assignee: LIEBHERR-COMPONENTS BIBERACH GMBH, Biberach/Riss (DE)

( * ) Notice: Subject to any disclaimer, the term of this patent is extended or adjusted under 35 U.S.C. 154(b) by 817 days.

(21) Appl. No.: 13/083,978

(22) Filed: Apr. 11, 2011

(65) Prior Publication Data

US 2011/0248110 A1 Oct. 13, 2011

(30) Foreign Application Priority Data

Apr. 12, 2010 (DE) ..... 10 2010 014 649

(51) Int. Cl.
*E01C 23/088* (2006.01)
*E01H 5/09* (2006.01)
*E21C 31/02* (2006.01)

(52) U.S. Cl.
CPC ..... *E01C 23/088* (2013.01); *E01H 5/098* (2013.01); *E21C 31/02* (2013.01)

(58) Field of Classification Search
USPC ..... 310/52, 54, 58, 61, 63, 64, 156.01, 310/156.08, 156.34, 156.35; 404/90–94; 299/36.1, 39.1, 39.2, 39.4
See application file for complete search history.

(56) References Cited

U.S. PATENT DOCUMENTS 3,997,990 A 12/1976 Satterwhite
4,047,763 A * 9/1977 Gilliland et al. ..... 299/76
6,700,235 B1 * 3/2004 McAfee ..... 310/52
6,919,663 B2 * 7/2005 Iles-Klumpner ..... 310/156.53
7,633,193 B2 * 12/2009 Masoudipour et al. ..... 310/54
2002/0149289 A1 * 10/2002 Oda et al. ..... 310/261

(Continued)

FOREIGN PATENT DOCUMENTS

CN 101557143 10/2009
DE 2160643 6/1973

(Continued)

OTHER PUBLICATIONS

Machine Translation of Chinese doucment CN 101557143, Nov. 3, 2014.*

(Continued)

*Primary Examiner* — Sunil Singh
(74) *Attorney, Agent, or Firm* — Dilworth & Barrese, LLP

(57) ABSTRACT

The present invention relates to a self-propelled surface milling machine, preferably in the form of an asphalt-milling machine, snow-milling machine or Surface Miner, having a mill roll which is drivable about a rotational axis, and a mill roll drive comprising an electrical motor which is accommodated within the mill roll, wherein stator and rotor of the electrical motor are accommodated within a dust and air-tightly sealed motor housing. It will be suggested to associate a cooling device comprising a closed circuit liquid cooling system to the electrical motor located within the milling roll body. Due to the high heat capacity of a suitable coolant, such as oil or mixed water and glycol small volume flows and hence small conduit cross sections will be sufficient. On the other hand, any incorporation of dust into the mill-roll drive as well as any formation of dust by discharge air can be avoided by the closed form of the circuit liquid cooling system.

18 Claims, 4 Drawing Sheets

(56) References Cited

U.S. PATENT DOCUMENTS

| | | | | |
|---|---|---|---|---|
| 2005/0117970 | A1 | 6/2005 | Gaertner et al. | |
| 2006/0097595 | A1 * | 5/2006 | Randriamanantena | 310/156.08 |
| 2007/0278869 | A1 * | 12/2007 | Taketsuna | 310/54 |

FOREIGN PATENT DOCUMENTS

| | | | |
|---|---|---|---|
| DE | 19752003 | | 6/1999 |
| DE | 202007002403 | U1 * | 5/2007 |
| DE | 102007007996 | | 8/2008 |
| JP | 05207704 | A * | 8/1993 |
| WO | 2010012455 | | 2/2010 |

OTHER PUBLICATIONS

Chinese Office Action, Jul. 2014.
Russian Office Action.

* cited by examiner

SELF-PROPELLED SURFACE MILLING MACHINE WITH ELECTRICAL MILL ROLL DRIVE

BACKGROUND OF THE INVENTION

The present invention relates to a self-propelled surface milling machine, preferably in the form of an asphalt-milling machine, snow-milling machine or Surface Miner, having a mill roll which is drivable about a rotational axis, and a mill roll drive comprising at least one electrical motor which is accommodated within the mill roll, wherein stator and rotor of the electrical motor are accommodated within a dust and air-tightly sealed motor housing.

Surface milling machines are continually self-propelled working machines which, with the aid of a rotating roll, crush a layer of asphalt or soil or the like by milling and which commonly continuously proceed with the aid of caterpillars to force the roll into the milling goods. In doing this said roll forms the main operational unit requiring high energy and thus is in need of an appropriate drive. In this regard DE 10 2007 007 996 B4 suggests a diesel-electric drive, wherein the milling roll of a Surface Miner is driven by means of an electrical motor provided with energy by a generator. The references WO 03/058031 A1, DE 10 2008 008 260 A1, DE 10 2007 044 090 A1, DE 10 2007 028 812 B4, DE 199 41 800 C2, DE 199 41 799 C2 or DE 20 2007 002 403 U1 disclose further embodiments as well, wherein instead of electromotoric drives hydraulic drives are also utilized in part which are fed with hydraulic power by an hydraulic pump driven by a diesel engine.

From DE 10 2007 007 996 B4 a Surface Miner having an internal electrical motor drive for the mill roll is known. Here two squirrel cage motors each having an associated planetary gear are accommodated within the mill roll body, such that the mill roll drives are safely protected against external influences and damage by e. g. stones. In order to protect both gear and electrical motor against dust, adjacent front sides of the motor-gear-unit which is seated in a tubular frame part are sealed with pot-shaped housing parts which are brought into dust-tight connection with the support frame by a plug washer.

Having such encapsulated electric drives within the mill roll thermal problems will arise because heat generated in the gear and in the motor will not sufficiently be discharged.

Generally electrical motors are cooled by surface cooling or natural draft cooling having forced-air- or self-ventilation. However, these known methods of cooling do not apply to mobile surface milling machines such as Surface Miners, asphalt-milling machines and the like due to reasons of dust incorporation which may be caused by a mill roll operating in or on the soil. Furthermore, the drive, while in use, might also partially submerse into water, so an embodiment wherein the motor is sealed will be preferred. Moreover, depending on the soil at the operational site, heavy formation and resuspension of dust may be caused by strong flow of air that exits the motor, which might not be acceptable in most applications.

It has thus been considered, to provide aspiration of cooling air through a snorkel type of device on a highest point of the machine, as in this location low formation of dust and hence low incorporation of dust into the motor may be achieved. However, the problem of dust formation by the exiting cooling air is still to be solved.

Avoiding dust formation as far as possible can be achieved by a hermetically sealed motor wherein even exiting cooling air will be captured in a conduit and will be fed into an outlet at an elevated location on top of the machinery. Nevertheless a residual amount of dust will remain in the motor since dust formation is substantial with surface milling machines and aspirating power may not be increased arbitrarily.

Operating with a hermetically sealed motor wherein the air is circulated in a closed circuit air system and is cooled by means of a heat exchanger having an air inlet and outlet on top has been taken into account. Herein, however, a problem will arise in that the large amounts of air required for this will require very large conduit cross sections down to the mill-roll drive and backwards which hardly can be accommodated in limited location and accordingly are difficult to protect against mechanical damage.

SUMMARY OF THE INVENTION

Accordingly, the object of the present invention is to create an improved mobile surface milling machine of the type mentioned above, which circumvents prior art disadvantages and will suitably be elaborated by the invention. Especially a reduction in thermal stress of the mill roll drive shall be achieved without further increase of dust load.

According to the invention the object will be accomplished by a self-propelled surface milling machine according to the description herein. Preferred embodiments will be the object of the description herein.

It will thus be suggested, to associate a cooling device to the electrical motor of the mill roll rive which is located within the mill roll body, said cooling device having a closed circuit liquid cooling system. Due to high heat capacity of a suitable coolant, such as oil or mixed water and glycol, small volume flows and hence small conduit cross sections will be sufficient. On the other hand, any incorporation of dust into the mill-roll drive as well as any formation of dust by discharge air can be avoided by the closed form of the circuit liquid cooling system.

Basically heat discharge from the liquid coolant may be done by various methods. In one preferred embodiment the circuit liquid cooling system has an heat exchanger which is arranged outside the mill roll, for cooling of the coolant, the heat exchanger being connected to a section of the circuit liquid cooling system associated to the electrical motor by coolant conduits extending out of the front side of the mill roll and which preferably may further proceed along or within the support frame for supporting of the roller body. Said heat exchanger may basically be arranged within the mill roll as well, but outside the motor housing, in order to transfer heat from the coolant to the surroundings. However, being arranged outside the mill roll the oil cooler or the heat exchanger will be stroked closer by surrounding air. Said heat exchanger may advantageously be arranged in a location in the machine well above the mill roll, in order to avoid clogging of the heat exchanger by dust. For localization of the heat exchanger various positions may be taken into account.

For circulation of coolant a pump is provided which in one suitable embodiment of the invention may be arranged on one shaft end of the drive shaft of the electrical motor, the shaft end facing the external side of the mill roll. By this the pump is easy to access for maintenance. Suitably the pump is located outside the sealed motor housing, so there is no need to open the latter for maintenance.

Alternatively or additionally said pump may as well be utilised for circulation of the gear lubricant which lubricates a gear connected to the electrical motor. Even in this case said pump may suitably be arranged on the shaft end of the electrical motor outside the sealed motor housing, the shaft end being located beyond the mill roll. Said pump, the dual or multiple pumps may suitably be driven by the drive shaft of the electrical motor, respectively. However, alternatively or additionally, a separate drive motor may be employed for said pump as well.

In one advantageous embodiment of the invention a brake may be arranged on said shaft end of the electrical motor, the shaft end being located beyond the mill roll, which brake suitably acts on the drive shaft of the electrical motor and which accordingly also makes use of the transmission of the gear connected to the electrical motors for braking action, and consequently a smaller sized brake may be employed. Simultaneously the brake becomes easier to access and thus maintenance will be facilitated as well. In case that pump and brake will simultaneously be provided the brake, in one advantageous embodiment of the invention, may suitably be located between pump and electrical motor; thereby brake as well as pump is suitably arranged coaxially to the drive shaft of the electrical motor.

Basically the coolant of the circuit liquid cooling system may be circulated within the electrical motor by various methods. For example in one embodiment of the invention jacket cooling of the stator sheet or direct cooling of the stator winding may be provided, for example by a separation cylinder for the rotor. The coolant may also be led through a cylindrical liquid chamber formed by the housing or a cooling coil which may be integral with the housing or incorporated into the stator sheet package. In order to accomplish cooling of the rotor as well the liquid may be led through the rotor via a rotational passage.

Advantageously the cooling device for the electrical motor also provides cooling of the winding heads. Especially the cooling device in the internal space of the sealed motor housing may have a closed circuit liquid cooling system including forced circulation wherein the circuit liquid cooling system mentioned above has a heat exchanger which is stroked by the cooling air of the closed circuit liquid cooling system for cooling of the cooling air. Especially said cooling air may hereby be led across the winding heads for cooling. The cooling air will then be depleted of heat by heat exchange with the circuit liquid cooling system which in turn will discharge the heat to the surroundings.

Said forced circulation of the cooling air within the motor housing may advantageously be effected by at least one ventilation wheel which may be located on top of the motor shaft for co-rotation with the latter. Advantageously two of these ventilation wheels may be located on top of the rotor shaft which advantageously may be formed in the form of a radial fan.

In one embodiment of the invention the closed circuit air cooling system in the interior of the sealed motor housing will specifically be led across the winding heads. Therefore air passage means and/or guide means may be provided in the respective winding head space in order to guide the cooling air across the winding heads as well as through the cooling coils being exposed in the winding head spaces of the circuit liquid cooling system. By cooling down circulating internal air directly in or at the winding head space efficient cooling of the winding heads may be achieved without sacrificing a compact design. Incorporation of the cooling coils of the circuit liquid cooling system into the winding head is not required.

Basically said cooling air passage means and/or guide means may have various forms. In one embodiment of the invention they are provided such that cooling air at the neck of the winding head, i. e. at the transition between winding head and stator sheets, passes through the winding head and circulates around the winding head, whereby the air flow passing through the winding head will pass between the external side of the winding head and housing, circulating around the front side of the winding head to the internal side of the winding head or will pass backwardly around the winding head.

Especially the cooling air passage means and/or guide means may comprise preferably slot-shaped passage recesses in the winding head which are located on the neck of the winding head which are distributed across the circumference of the winding head. These passage recesses in the winding head may be achieved by various means keeping the winding cords on the neck of the winding head apart or spreading them apart. For example sleeve-shaped spacers may be provided between the cord strands exiting the stator sheets. In one embodiment of the invention other spacers preferably in the form of loops or ribbons may also be provided which will bundle the winding cords and which will keep the desired slot-shaped passage recesses clear.

In addition or as an alternative to the passage recesses mentioned above, extending radially through the winding head, cooling air recesses extending through the winding head approximately axially in longitudinal direction may also be provided. In case that radial passage recesses described above are provided, these advantageously are in communication with said axial cooling air recesses. Thereby, improved cooling may as well be accomplished in the front area of the winding head.

In one embodiment of the invention the air passage means and/or guide means for the cooling air define a multitude of flow paths passing annularly around the winding heads, each one passing through said passage recesses and annularly around a respective segment of the winding head in which a respective passage recess is provided. Said flow paths each pass radially through a passage recess, followed by axially passing between the winding head and the machine housing and then along the winding head, followed by radially passing around a section of the winding head located on the front side and axially on an internal side of the winding head back to the passage recess; optionally flow direction may also be oriented in reverse direction.

The cooling coils may basically be located in various places within the winding head space; however, they are advantageously positioned in a section with strong cooling air circulation. In one advantageous embodiment of the invention the cooling coils may be located at the front sides of the winding heads. Thereby, high transfer of heat from the cooling air into the cooling coils can be accomplished while at the same time a compact design will be achieved.

In order to achieve cooling of the rotor cooling air may also be led into the rotor. In order to achieve this, it will especially be provided that the winding head spaces, while being circuit closed air spaces, i. e. which are not in communication with the outer side of the machine, are, however, connected to each other via at least one air duct extending axially through the rotor. Advantageously, four or more axial cooling air recesses may pass through the rotor through which the two winding head spaces including circulating cooling air can communicate with each other.

To achieve this, in one advantageous embodiment of the invention, the cooling air is led through the rotor in countercurrent. Said air passage means and/or guide means advantageously comprise a countercurrent device leading cooling air through the cooling air recesses in the rotor in the opposite direction. While a first set of cooling air recesses passes cooling air from a left side winding head space to a winding head space on the right side a second set of cooling air recesses in the rotor functions to pass cooling air in the opposite direction from the right side winding head space into the winding head space on the left side.

Said countercurrent device may comprise attachment plates mounted directly on the rotor which are provided with vent holes each being in flow communication with at least one air duct in the rotor, the attachment plates located on adjacent front sides of the rotor being rotationally offset against each other in such that said vent holes of one attachment disc are in communication with a first set of air ducts of the rotor and the vent holes of the other attachment disc are in communication with a second set of air ducts of the rotor. Said attachment plates may advantageously constitute part of said ventilation wheels and possess paddle-shaped air conveying means. Advantageously said ventilation wheels may exhibit radial deviation means taking the form of the attachment plates extending through the passage recesses into the winding head, while on the other hand the vent holes pass by the ventilation part and constitute inlet ducts each being in communication with at least one cooling air duct in the rotor.

In this context rotor ducts may be provided which on one side are connected to the internal side of the winding head through vent openings in the attachment disc and will lead into the inner circumferential side of the radial paddles of the respective attachment disc on the external side.

Specifically if the motor is frequently operated at rpm significantly below its nominal rotation speed the conveying effect of such ventilation wheels driven by the motor shaft is no longer sufficient to cool the rotor. In one advantageous embodiment of the invention at least one ventilation wheel that can be driven by a fan motor independently from the rotor shaft may also be provided alternatively or in addition to said ventilation wheels located on the rotor shaft.

Alternatively or additionally, in an embodiment of the invention, instead of an air- or liquid-cooled asynchronous squirrel-cage motor, a motor requiring no or almost no cooling of the rotor may be used. Especially, the electrical motor may be designed as a synchronous motor with a permanent magnet rotor. In such a permanent magnet type synchronous motor, comprising permanent magnets in the rotor instead of rotor bars, there are almost no rotor losses, so that no intensive cooling of the rotor is required.

BRIEF DESCRIPTION OF THE DRAWINGS

The invention is exemplified in more detail by way of examples of preferred embodiments and the accompanying drawings wherein.

DESCRIPTION OF THE PREFERRED EMBODIMENTS

Figure 1:
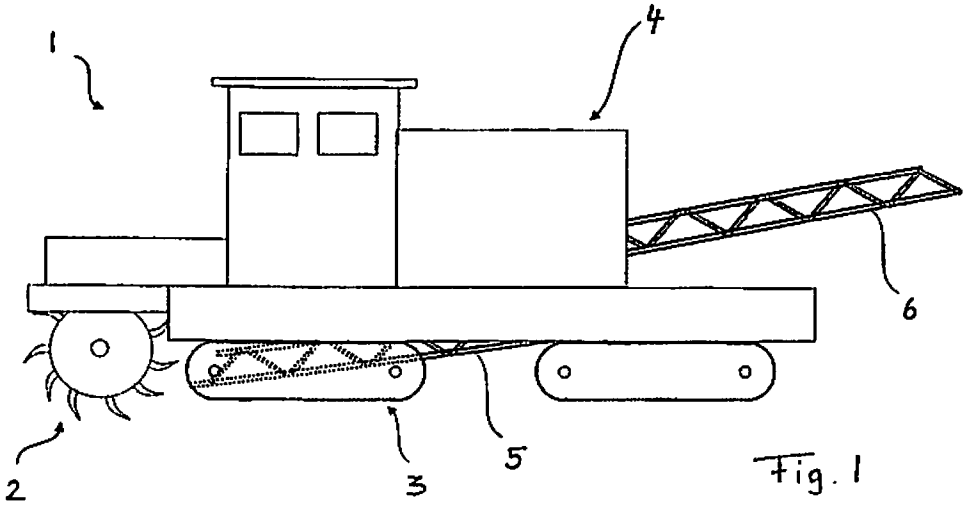
FIG. 1: is a schematic representation of a self-propelled surface milling machine in the form of a Surface Miner, which may, however, according to one advantageous embodiment of the invention, be as well designed as an asphalt milling machine.

FIG. 1 shows a self-propelled surface milling machine such as a Surface Miner or asphalt milling machine, the main working unit thereof being a mill roll 2 which is rotationally drivable about a horizontal axle, the circumference of the former being equipped with milling tools suitable to crush a soil or asphalt layer in a milling action. Thereby, the surface milling machine 1 is continuously advanced by means of caterpillars 3 so that said mill roll 2 experiences continuous feed motion. Machine body 4 for which said caterpillars 3 provide mobile support on the ground and support of said mill roll 2 furthermore comprises conveying means for eliminating milled material. The milled material derived from the mill roll will then be transferred to an receiving conveyor 5 passing the milled material to a loading conveyor 6 for transfer of crushed material, for example, to a truck. Said receiving and loading conveyors 5 and 6 may, for instance, be designed as conveyor belt systems.

Figure 2:
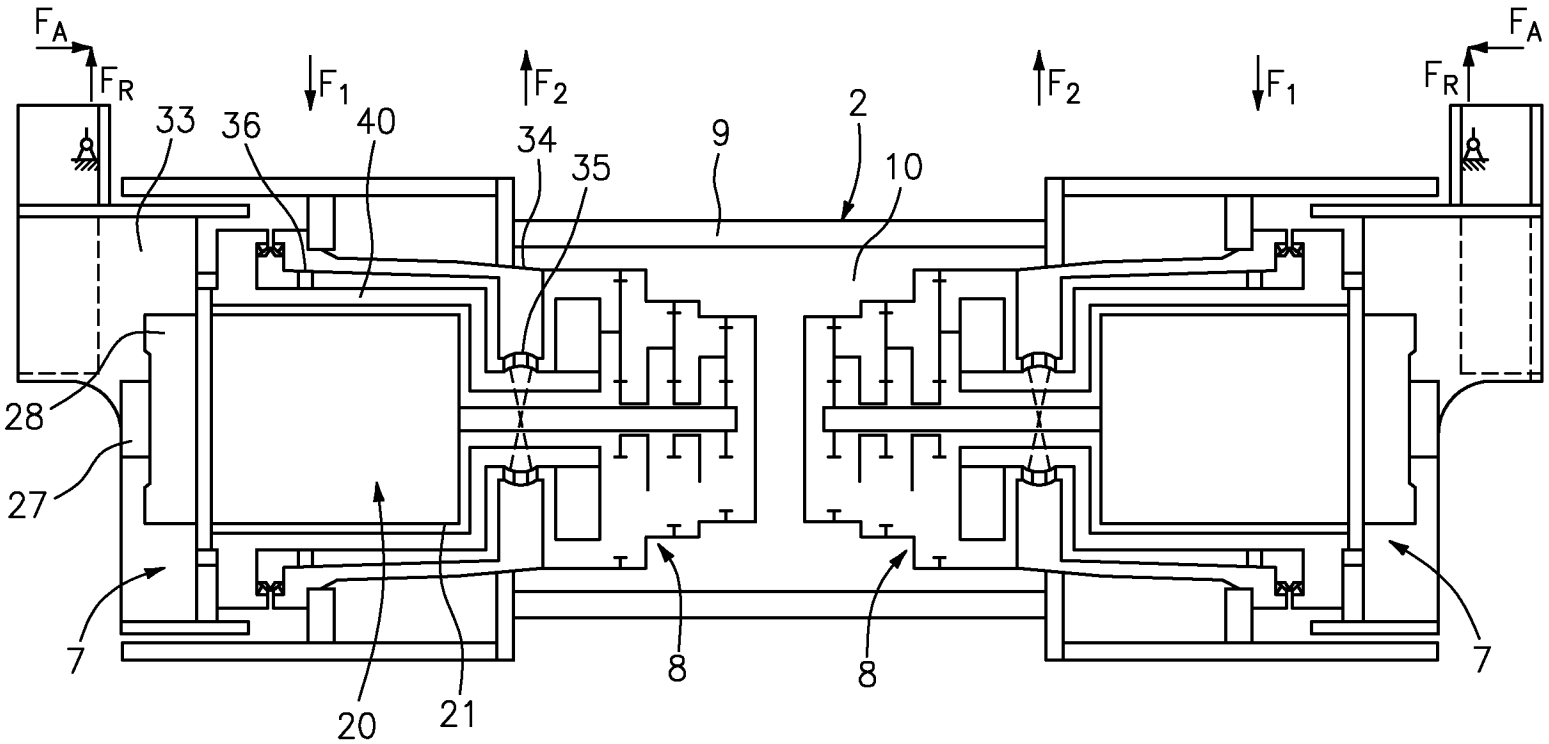
FIG. 2: is a schematic longitudinal section across the mill roll of the surface milling machine of FIG. 1, showing two mill roll drive units accommodated in the interior of the mill roll, each designed as an electrical motor with coupled planetary gear.

According to FIG. 2, said mill roll 2 may be driven by electrical motors 20 which are connected to mill roll 2 by means of a gear designed as a planetary gear 8 and which optionally may be located inside the mill roll. Mill roll drives 7 each consisting of an electrical motor 20 and a planetary gear 8 at the same time serve for supporting of mill roll body 9. As shown in FIG. 2, the two mill roll drives 7 are located on the right and left side inside the mill roll body 9 so that they preferably do not protrude from the front side of mill roll body 9. The electrical motor 20 of each mill roll drive 7 is rigidly fixed to a support frame part 33 via its motor housing 21 and a support housing part 40, the support frame part 33 engaging into the front side of the mill roll body 9 and being connected to the machine body 4 of the surface milling machine 1. Alternatively, the motor housing 21 may constitute part of the support housing. A second support housing part 34 is in turn pivotally mounted, thereby applying two pivotal mounting points as far apart from each other as possible, and rigidly formed in axial and radial directions. In the embodiment shown in FIG. 2 a conically shaped tilted fixed support 35 as well as a spaced radial support 36 are employed, cf. FIG. 2.

Advantageously said gear 8 is designed as a planetary gear which may be designed as a multiple stage gear to permit realisation of a suitably large transmission stage within a small installation space.

As a power supply for electrical motors 20 a generator which is driven by a combustion engine, for example in the form of a diesel engine is advantageously provided.

Advantageously the electrical motors 20 may be fed from the generator optionally through a frequency converter or directly, i. e. in the absence of frequency converter or with the frequency converter being bridged, respectively. Actually a jumper will form a bypass of the supply conduit circumventing the frequency converter, said jumper being switchable by means of a switching element, for example designed as a circuit breaker, so that the motor can optionally be supplied either through the frequency converter or by circumventing the same.

Instead of using multiple electrical motors 20 for driving the main working unit 2 only one electrical motor may be provided. In the embodiment shown two electrical motors 20 are provided each being in drive connection with mill roll 2.

Figure 3:
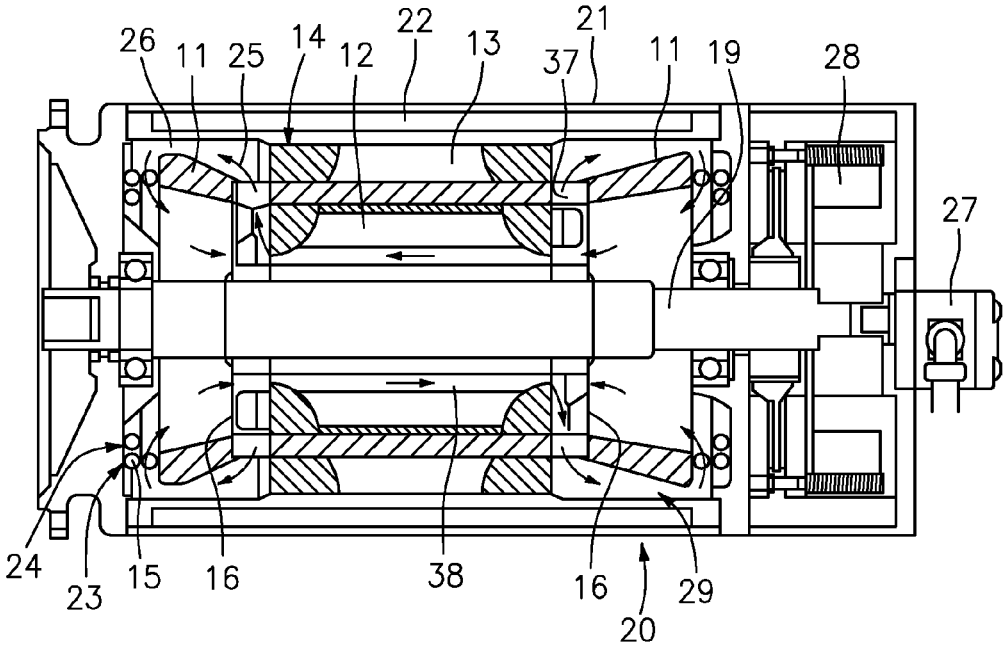
FIG. 3: is a longitudinal section across one of the electrical motors of FIG. 2, showing the closed circuit air system within the sealed motor housing, the cooling air being led in countercurrent direction through axial cooling air recesses from one winding head space to the winding head space on the opposite side and backwards.

The electrical machine 20 shown in FIG. 3 comprises a shaft 19 with a rotor 12, which both are pivotally mounted on support plates constituting part of a machine housing 21 and/or which frontally seal a jacket 22 surrounding stator 13 of the machine 20. Said jacket 22 is provided with a jacket cooling through which coolant is circulated in a liquid cooling circuit 23. Said jacket is attached gap-free, flush and/or flatly to the stator sheets in order to properly achieve heat transfer from stator 13 into the cooling jacket 22.

In addition to said liquid cooling circuit 23 cooling device 24 of the electrical machine 20 comprises an air cooling 25 for cooling of the winding heads 11 protruding into the winding head spaces 26, which are defined by housing 21 or more precisely jacket 22 and support plates on both sides of stator 13 and rotor 12. As shown in FIG. 3, stator 13 comprises a winding 14 which is partially embedded into the stator sheets of the stator 13 and beyond said stator sheets will form basket-shaped winding heads 11 from both sides.

For cooling of said winding heads 11 an internal circulation of cooling air will be generated by ventilation wheels 16, i. e. no surrounding air will be passed through the machine or over the winding heads 11, respectively, but an internal circuit air cooling system will be generated for cooling said winding heads 11. In order to withdraw heat from cooling air as shown in FIG. 3 cooling coils 15 are provided in the winding head spaces 26 through which coolant is circulated. The circuit liquid cooling system extending through said cooling coils 15 may principally be separated from circuit liquid cooling system 23 of the jacket cooling 22. However, connection of the cooling coils 15 to the circuit liquid cooling system 23 of the jacket cooling may advantageously be provided, which, depending on the thermal load of each of the machine parts, will apply parallel or serial connection of the cooling coils 15 to the jacket cooling 22 and the circuit liquid cooling system 23 feeding the latter.

In order to achieve effective cooling of circulating cooling air said cooling coils 15 are advantageously provided with ribs on their external surface, for instance in the form of multiple axial ribs on each cooling coil to increase size of the heat transfer surface of cooling coils.

In the embodiment shown in FIG. 3 cooling coils 15 are essentially located on the front side of the winding heads 11 in a gap provided between the front side of said winding heads 11 and the support plates, said cooling coils 15 essentially extending annularly about the axle of shaft 19.

In the embodiment according to FIG. 3 ventilation wheels 16 effecting air circulation are located directly on said shaft 19 and are driven by the latter. Advantageously, said ventilation wheels 16 are accommodated in the internal space 26 of the basket-shaped winding heads 11. In the embodiment shown the ventilation wheels 16 are provided with radially operating paddles such that air is forced radially into the annular interstice limited by winding heads 11 from the inside and by jacket 22 from the outside, cf. FIG. 3.

Figure 4:
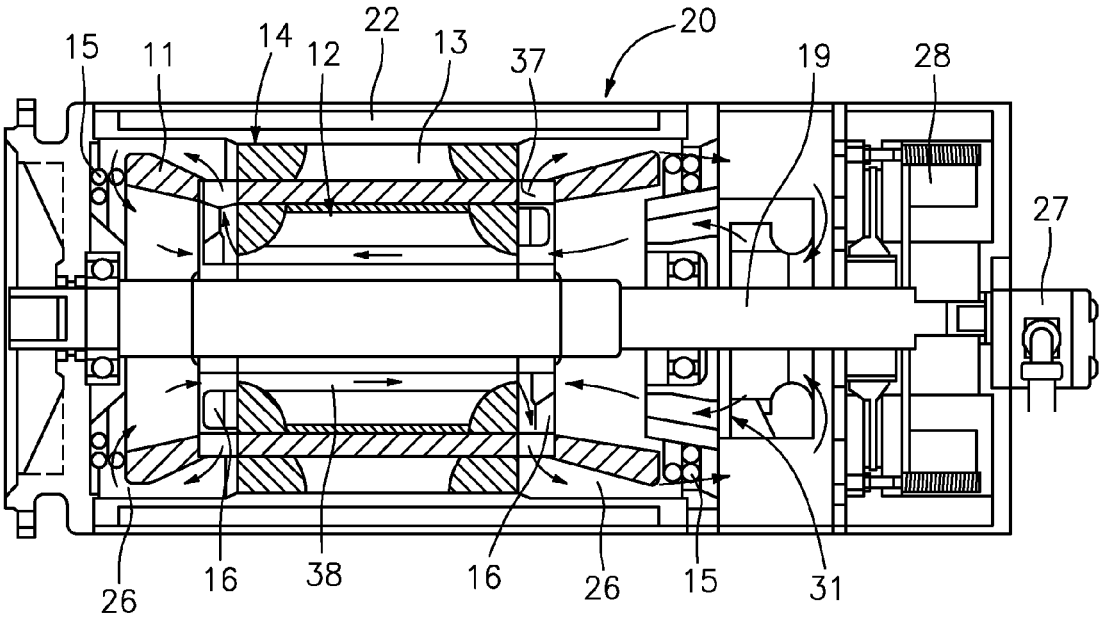
FIG. 4: is a longitudinal section across one of the electrical motors of FIG. 2 according to another embodiment of the invention, wherein a radial fan is provided on the shaft beyond the support plate of the motor.

As is shown FIGS. 3 and 4 winding heads 11 are provided with radial passage recesses 37 at their necks, i. e. in the transitional area towards the stator sheets, allowing the cooling air to pass through winding heads 11.

Said passage recesses 37 constitute part of air passage means and guide means effecting annular air circulation around basket-shaped winding heads 11, as exemplified by flow arrows in FIG. 3. The cooling air forced towards the neck of the respective winding head 11 by ventilation wheels 16 passes through said passage recesses 37 and is then led along winding head 11 onto its outside surface, passing between winding head 11 and jacket 22 to the front side of the respective winding head 11 and around this front side back to the internal side of winding head 11. Meanwhile the cooling air strikes over cooling coils 15 at the front side of winding head 11 so that heat previously transferred to the cooling air by the winding of winding head 11 will be withdrawn.

The cooling air guidance further comprises air ducts 38 across rotor 12 from one winding head space 26 to the other winding head space on the opposite side and backwards.

This cooling air guidance is effected by ventilation wheels 16 which are designed as attachment plates or compression plates respectively and which closely fit to the front side of the rotor 12 and are located on shaft 19. The ventilation wheels essentially consist of a radially cantilevered flange to which suitable air conveyance means, for instance in the form of conveyor blades or conveyor paddles, respectively, are attached, and which is provided with vent holes which are located across the circumference and which are in communication with axial cooling air recesses or air ducts 38, respectively, in rotor 12, said air ducts axially passing through said rotor 12 and each one exits said rotor 12 on the front side thereof. The number of air ducts 38 in rotor 12 is twice of that of the vent holes in the attachment plates so that each of the attachment plates will be in communication with every other one of said air ducts 38 in rotor 12 by means of its vent holes. The two attachment plates are rotationally offset against each other such that a first set of air ducts 38 in rotor 12 is in communication with the left internal space of the winding head 11 via the vent holes while a second set of air ducts 38 of the rotor 12 is in communication with the internal space of the winding head 11 on the right side via the vent holes located in the other attachment disc so that cooling air circulation as exemplified by the flow arrows in FIG. 3 is achieved.

Cooling air circulation is embodied as follows: The fan of the ventilation wheels 16, operating radially, forces cooling air through the passage recesses 37 provided at the necks of the winding heads 11 to the outside of the winding heads 11. The cooling air forced through passage recesses 37 then circulates around winding heads 11 similarly to air guidance shown in FIG. 3, striking the external side between respective winding head 11 and jacket 22, followed by surrounding the front side of winding head 11 and passing through cooling coils 15, then reaching the internal side of winding heads 11. From this point cooling air is forced into the vent holes of the respective attachment disc which in this respect constitute inlet ducts for air ducts 38 of the rotor 12. The cooling air then passes via said cooling air ducts 38 through rotor 12, reaching the fan of ventilation wheel 16 of the attachment plate provided on the external side of the rotor. At this point, the cooling air will accordingly pass through and around winding head 11 and then return across rotor 12 in countercurrent direction so that by said two ventilation wheels 16 a countercurrent cooling air flow is generated in rotor 12.

The electrical machine shown in FIG. 4 is essentially designed according to the machine shown FIG. 3, the difference essentially being in that flow of internal air is generated by ventilation wheel 31 mounted on the shaft beyond the support plate and forces internal air into air ducts 38 of the rotor behind cooling coil 15 on the right side of FIG. 4, said support plate being provided with cooling air outlets and inlets, so cooling air can be circulated across the external surface of said support plate. For this purpose a bowl-shaped housing cap through which a closed circuit liquid cooling system is provided, is located on said outer side of the support plate. During standstill or at low rpm extensive cooling of the electrical machine 20 may be achieved by means of a fan motor. In this case the fan motor will drive an additional ventilation wheel mounted on the fan motor which in turn is mounted on the external side of the support plate.

Figure 5:
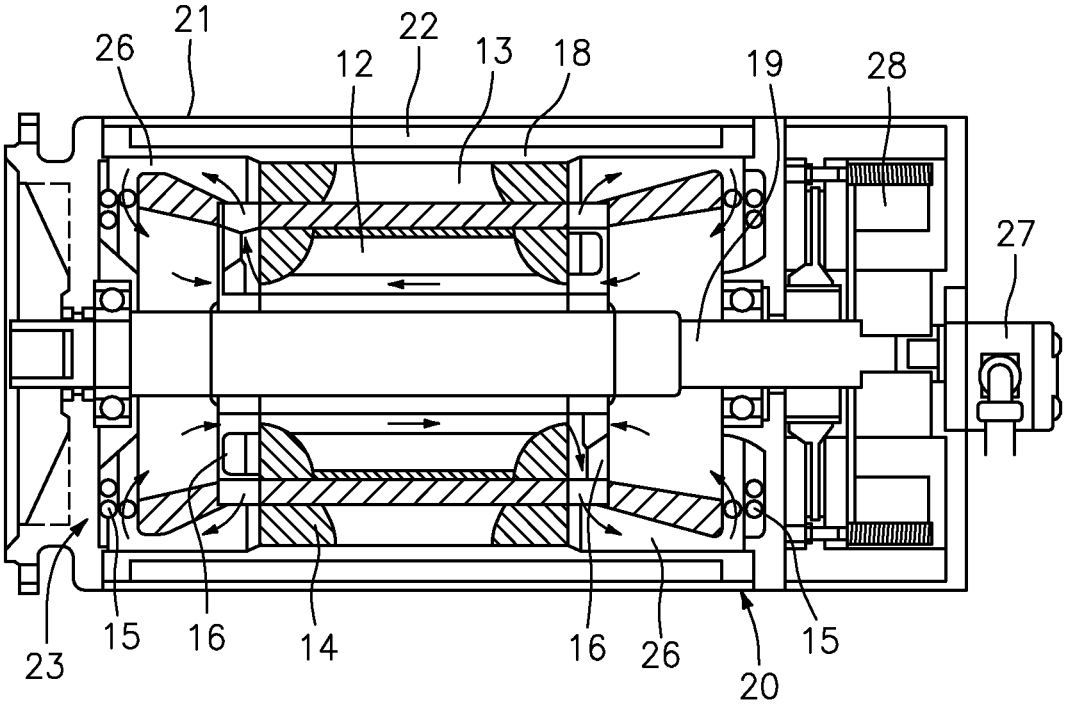
FIG. 5: is a longitudinal section across one of the electrical motors of FIG. 2 according to another advantageous embodiment of the invention, wherein the electrical motor is designed as a synchronous motor with a permanent magnet rotor and the cooling air circuit is designed to provide cooling of the winding heads and is led in countercurrent direction through recesses in the rotor from one winding head space to the winding head space on the opposite side and backwards.

In the embodiment according to FIG. 5 the electrical motor is designed as a synchronous motor with a permanent magnet rotor wherein the rotor does not contain bars but permanent magnets. This results in that almost no rotor losses occur so that the motor does not require extensive rotor cooling. As shown in FIG. 5 the circuit liquid cooling system 23 may possess a jacket cooling section for cooling of jacket 22 and thus may furthermore comprise cooling coils 15 in winding head spaces 26 for cooling of the cooling air therein.

The permanent magnet motor 20 comprises a rotor 12 equipped with permanent magnets 18 mounted on shaft 19 and having a stator 13 which is cooled by said liquid jacket cooling, which can be combined with an external heat exchanger serially, in parallel, or with both of them. The ventilation wheels 16 mounted on the shaft 19 will initiate the internal air flow within the respective winding head spaces 26. The air passes through winding 14 as well as cooling coils 15, which preferably consist of ribbed coils within the respective winding head space 26, thereby forming a closed circuit.

As shown in FIGS. 3 to 5, a pump 27 is advantageously located at the end of drive shaft 19 of the electrical motor 20 facing the external surface of mill roll body 9 of mill roll 2 which may serve for the circulation of the coolant of the circuit liquid cooling system 23 and/or for the circulation of lubricant for the planet gear 8 coupled with the electrical motor 20. If oil is used as a coolant the oil may possibly be pumped through the electrical motor in order to provide cooling thereof as well as through the gear in order to provide lubrication as well as cooling thereof. Alternatively, however, the pump may also comprise two separate pump units, wherein one of which will circulate the coolant while the other one will circulate the lubricant for the gear.

Said pump 27 is advantageously driven by drive shaft 19 of the electrical motor 20.

As shown in FIG. 2, in addition to pump 27 a brake 28 may also be provided at said shaft end. Optionally additional parts such as a rotation sensor may be provided. By arranging of pump 27 and brake 28 outside the motor housing 21 on the shaft end located on the outside of the mill roll of the electrical motor 20 ease of accessibility of said components is provided, thus further increasing availability of the machine. This easy-to-maintain construction also has the advantage in that brake 28, even if it is exclusively designed as a holding brake, can be used as an emergency stop, although it will thermally be overloaded during this. This is due to the fact that its easy accessibility allows rapid repair. Furthermore, due to arranging the pump 27 at the end of the shaft of the electrical motor 20 no further additional power supply, for instance by means of wires, will be required.

The invention claimed is:

1. Self-propelled surface milling machine, having a mill roll (2) which is drivable about a rotational axis, and a mill roll drive (7) comprising at least one electrical motor (20) which is accommodated within the mill roll (2), stator (13) and rotor (12) of the electrical motor (20) being accommodated within an internal space (29) of a dust and air-tightly sealed motor housing (21) wherein a cooling device (24) comprising a closed circuit liquid cooling system (23) is associated with the at least one electrical motor (20) wherein the closed circuit liquid cooling system (23) includes circulation of a coolant through a closed loop, the mill roll (2) defining a front side positioned at an end of a longitudinal axis of the mill roll (2), wherein the circuit liquid cooling system (23) has a heat exchanger which is located outside of the mill roll (2), for cooling of coolant, which is connected to one part of the circuit liquid cooling system (23) associated to the at least one electrical motor (20) by coolant conduits extending out of the front side of the mill roll (2) to the exterior.

2. Self-propelled surface milling machine according to claim 1, wherein a pump (27) is arranged on a shaft end of a drive shaft (19) of the electrical motor (20), the shaft end being located outside the mill roll, for recirculation of the coolant and/or a gear lubricant.

3. Self-propelled surface milling machine according to claim 2, wherein for forced circulation of cooling air in the motor housing internal space (29) at least one ventilation wheel is provided, which may be driven by a ventilation motor independently of motor shaft (19).

4. Self-propelled surface milling machine according to claim 2, wherein the cooling device (24) in the internal space (29) of the sealed motor housing (21) has a closed circuit air cooling system (25) with forced circulation for cooling of winding heads (11) and the rotor (12) and the circuit liquid cooling system (23) has a heat exchanger which is stroked over by the cooling air from the closed circuit air cooling system (25), for cooling of the cooling air.

5. Self-propelled surface milling machine according to claim 4, wherein for forced circulation of the cooling air a ventilation wheel (16), seated on the drive shaft (19) is provided.

6. Self-propelled surface milling machine according to claim 1, wherein the cooling device (24) in the internal space (29) of the sealed motor housing (21) has a closed circuit air cooling system (25) with forced circulation for cooling of winding heads (11) and the rotor (12) and the circuit liquid cooling system (23) has a heat exchanger which is stroked over by the cooling air from the closed circuit air cooling system (25), for cooling of the cooling air.

7. Self-propelled surface milling machine according to claim 6, wherein for forced circulation of the cooling air a ventilation wheel (16), seated on a drive shaft (19) is provided.

8. Self-propelled surface milling machine according to claim 7, wherein a stator winding (14) of the stator (13) comprises winding heads (11) located at the opposite sides of each one winding head space (26), cooling coils (15) of the circuit liquid cooling system (23) extending across the winding head spaces (26) from the outside of the winding head (11) and the air cooling system comprises two ventilation wheels (16) for the generation of an airflow circulating within each winding head space (26), each ventilation wheel being associated to one of the winding head spaces (26), the airflow being led through the cooling coils (15) and circulating through the winding heads (11) by air duct means or air duct guiding means located in each of the winding spaces.

9. Self-propelled surface milling machine according to claim 8, wherein the air duct means or air duct guiding means define a plurality of flow paths leading around winding heads (11) in an annular manner, the flow paths each comprising passage recesses (37), an external part between each of winding head (11) and shell (22), a front flow path section between the front sides of the winding head and support plates as well as an internal part located on the internal side of the winding heads (11).

10. Self-propelled surface milling machine according to claim 8, wherein the cooling coils (15) are arranged on the front side of the winding heads (11).

11. Self-propelled surface milling machine according to claim 1, wherein winding head spaces (26) form air circulation spaces and are connected to each other by air passages (38), extending through rotor (12).

12. Self-propelled surface milling machine according to claim 1, wherein air duct means or air duct guiding means comprise counter-flow means for passing of cooling air through rotor (12) in an opposite direction.

13. Self-propelled surface milling machine according to claim 1, wherein for forced circulation of cooling air in the motor housing internal space (29) at least one ventilation wheel (31) is provided, which may be driven by a shaft and is seated outside of support plate which has cooling air exit and cooling air entrance holes.

14. Self-propelled surface milling machine according to claim 1, wherein electrical motor (20) is formed as a synchronous motor with permanent magnet rotor.

15. Self-propelled surface milling machine according to claim 1, wherein a pump (27) is arranged on a shaft end of a drive shaft (19) of the electrical motor (20), the shaft end being located outside the mill roll, for recirculation of the coolant and/or a gear lubricant.

16. Self-propelled surface milling machine according to claim 15, wherein the cooling device (24) in the internal space (29) of the sealed motor housing (21) has a closed circuit air cooling system (25) with forced circulation for cooling of winding heads (11) and the rotor (12) and the circuit liquid cooling system (23) has a heat exchanger which is stroked over by the cooling air from the closed circuit air cooling system (25), for cooling of the cooling air.

17. Self-propelled surface milling machine according to claim 16, wherein for forced circulation of the cooling air a ventilation wheel (16), seated on the drive shaft (19) is provided.

18. Self-propelled surface milling machine according to claim 1, wherein the cooling device (24) in the internal space (29) of the sealed motor housing (21) has a closed circuit air cooling system (25) with forced circulation for cooling of winding heads (11) and the rotor (12) and the circuit liquid cooling system (23) has a heat exchanger which is stroked over by the cooling air from the closed circuit air cooling system (25), for cooling of the cooling air.

* * * * *